United States Patent [19]

Cooper et al.

[11] Patent Number: 4,529,140

[45] Date of Patent: Jul. 16, 1985

[54] CONTINUOUS STRIP ACCUMULATOR

[75] Inventors: Christopher C. Cooper, Brunswick; Dimitri Economou, Cleveland Hts., both of Ohio

[73] Assignee: Guild International Inc., Bedford, Ohio

[21] Appl. No.: 507,151

[22] Filed: Jun. 23, 1983

[51] Int. Cl.[3] ..... B65H 75/02

[52] U.S. Cl. ..... 242/55; 242/55.21

[58] Field of Search ..... 242/55.21, 55, 78.1, 242/78.6, 55.19 R, 55.18

[56] References Cited

U.S. PATENT DOCUMENTS

| | | | |
|---|---|---|---|
| 1,716,774 | 6/1929 | Halla | 242/55.21 |
| 2,037,601 | 4/1936 | Shirlow et al. | 242/55.21 |
| 3,034,399 | 7/1959 | Goepel | 242/55.19 R |
| 3,310,255 | 3/1967 | Sendzimir | 242/78.1 |
| 3,506,210 | 4/1970 | LaTour et al. | 242/78.1 |
| 3,722,809 | 3/1973 | Leisring | 242/55 X |
| 3,782,662 | 1/1974 | Miller | 242/55 |
| 3,860,188 | 1/1975 | Bradshaw | 242/78.1 X |
| 3,885,748 | 5/1975 | Costello et al. | 242/55 |
| 3,999,718 | 12/1976 | Ziemba | 242/55.19 R X |
| 4,288,042 | 9/1981 | Sendzimir | 242/55.19 R X |
| 4,410,121 | 10/1983 | Wheeler et al. | 242/55 X |
| 4,441,661 | 4/1984 | Steinmair | 242/55 |
| 4,456,189 | 6/1984 | Wheeler et al. | 242/55 |
| 4,473,193 | 9/1984 | Cooper et al. | 242/55 |

*Primary Examiner*—Stephen Marcus
*Assistant Examiner*—Leo J. Peters
*Attorney, Agent, or Firm*—Maky, Renner, Otto & Boisselle

[57] ABSTRACT

Continuous strip accumulator includes a convolution transfer annulus providing for controlled expansion and contraction of the stored convolutions between inner and outer sections within the accumulator. During mill match operation of the accumulator, the convolution transfer annulus is retained against movement but still provides support for the strip material as it moves from the inner section to the outer section. A differential drive between the entry and exit pinch rolls provides for mechanical synchronous operation of the entry and exit pinch rolls during the mill match mode. During the welding mode, when it is desired to replenish the supply of strip material, movement of the incoming strip is stopped and the convolution transfer annulus is driven by the differential drive in a direction causing positive transfer of the convolutions from the outer section to the inner section in mechanical synchronism with the exit pinch rolls to provide a continuous uninterrupted supply of strip material to the mill. After the supply has been replenished, the entry pinch rolls are accelerated to fill speed during which the differential drive first causes the convolution transfer annulus to decelerate down to zero and then accelerate in the opposite direction for effecting positive transfer of the stored convolutions from the inner section to the outer section to expand the convolutions and refill the accumulator. Radially extending horizontal drive rolls and idle rolls support the stored convolutions in the inner and outer sections, respectively. Lower strip edge support rollers are desirably provided at the convolution transfer point on the convolution transfer annulus to raise the transition spiral somewhat as the convolutions are being transferred between the inner and outer sections in order to substantially eliminate any sliding contact between the transition spiral and the horizontal support rolls between which the convolutions are being transferred. A mechanical drive connection between the inner drive rolls and entry and exit pinch rolls provides for mechanical synchronous operation thereof.

45 Claims, 5 Drawing Figures

CONTINUOUS STRIP ACCUMULATOR

BACKGROUND OF THE INVENTION

This invention relates generally as indicated to a continuous strip accumulator, and more particularly to an improved accumulator apparatus for storing in an expanding and contracting spiral a length of strip material received from a source of supply and feeding such strip material to a mill, machine or other apparatus without interruption while the source of supply is being replenished.

Continuous strip accumulators of various types have previously been provided for storing a length of strip material in an expanding and contracting spiral coil having a fixed number of turns with the strip material being fed to the inside of the spiral coil and withdrawn from the outside or vice versa. One such accumulator which has operated satisfactorily is disclosed in U.S. Pat. No. 3,860,188. However, one drawback of this type of accumulator is that all of the drive rolls and pinch rolls are independently driven by separate D.C. motors which, together with their associated electrical controls, add considerably to the overall cost and complexity of the accumulator as well as the maintenance thereof. Also, a dancer roll is normally required to provide a feedback signal to the drive motor for the entry pinch rolls to regulate the speed of the incoming strip, which further adds to the cost and complexity of the accumulator.

The drive rolls for supporting the spiral coil in previous known accumulators are also usually inclined and/or skewed to assist in the expansion of the coil during the filling operation, and are usually solid hardened ground rolls which are not only quite costly, but add considerably to the weight of the accumulator. The skewed drive rolls also result in a change of the angle of the strip material to the rolls with each convolution, causing a different velocity relationship for each convolution. Moreover, the drive rolls normally are continuously driven during contraction of the spiral coil, thus necessitating the provision of several lifting stations around the inner periphery of the accumulator and associated controls for successively lifting the convolutions off the drive rolls after they have been contracted, which further adds to the cost of the accumulator and requires additional maintenance.

Another objection to such prior accumulators is that during expansion and contraction of the spiral coil within such accumulators, that portion of the strip material being expanded or contracted is substantially unsupported, thus making such operation rather delicate. Also, because of such lack of support, there is considerable contact surface pressure between convolutions, thus necessitating that the strip material be put under increased tension during the filling mode to overcome such pressure.

SUMMARY OF THE INVENTION

With the foregoing in mind, it is a principal object of this invention to provide a continuous strip accumulator in which the strip material is positively supported during movement between inner and outer sections within the accumulator.

Another object is to provide such an accumulator in which there is controlled expansion and contraction of the stored convolutions between such inner and outer sections.

A further object is to provide such an accumulator in which the contact surface pressure between the stored convolutions is minimal.

Another object is to provide such an accumulator which is internally mechanically synchronized, thus eliminating the need for any feedback signals to obtain such synchronous operation.

Still another object is to provide such an accumulator in which both the exit and entry pinch rolls are mechanically synchronously driven during mill match operation to ensure that the in-feed and out-feed of the strip material to and from the accumulator are the same.

A further object is to provide such an accumulator in which the driving force to the entry pinch rolls during mill match operation is obtained from the mill to which the strip material is being fed.

Another object is to provide such an accumulator with radially extending horizontal support rolls for supporting the strip convolutions within the inner and outer accumulator sections.

A still further object is to provide such an accumulator in which relatively short drive rolls and idle rolls are provided for supporting the convolutions of strip material within the inner and outer sections of the accumulator.

Another object is to provide such an accumulator in which all of the drive rolls and entry and exit pinch rolls are mechanically interconnected by means of a differential drive for synchronous mechanical operation thereof.

Still another object is to provide such an accumulator which produces less roll wear than in previous known accumulators.

Yet another object is to provide such an accumulator which produces lower contact pressures between the edge of the strip material and the support rolls therefor.

Another object is to provide such an accumulator with a differential drive providing for mechanical synchronization of the entry and exit pinch rolls during mill match operation when the convolution transfer annulus is locked against movement, providing for mechanical synchronous operation of the exit pinch rolls and convolution transfer annulus causing the convolution transfer annulus to rotate in a direction for transferring the convolutions from the outer section to the inner section during the supply replenishing operation when the entry pinch rolls are retained against movement, and providing for rotation of the convolution transfer annulus in the opposite direction to transfer the convolutions from the inner section to the outer section during refilling of the accumulator when the entry pinch rolls are driven at a speed greater than the speed of the exit pinch rolls.

A further object is to raise the transition spiral up somewhat during transfer of the convolutions between such inner and outer sections to substantially eliminate any sliding contact between the transition spiral and the horizontal support rolls in the inner and outer sections thus ensuring chatter free motion of the transition spiral along the axes of such horizontal support rolls.

Yet another object is to provide such an accumulator of the type indicated which is less expensive to manufacture and maintain and is lighter than previous known accumulators of the same general capacity.

A still further object is to provide such an accumulator which may be used with a relatively wide range of material thicknesses and width ratios.

These and other objects of the present invention may be achieved as by providing the accumulator with a convolution transfer annulus through which controlled expansion and contraction of the stored convolutions is obtained between inner and outer sections within the accumulator. Radially extending horizontal support rolls are desirably provided in the inner and outer sections, respectively, of the accumulator to provide for lower contact pressures between the supported edge of the strip material and support rolls and reduced roll wear. Also, because such rolls are radial, relative sliding of the strip material on the rolls is substantially reduced.

During mill match operation of the accumulator, the convolution transfer annulus is held against movement but still provides support for the strip material and guides the strip material during its movement from the inner section to the outer section. A lower strip edge support roller is desirably provided on the convolution transfer annulus to raise the transition spiral bottom edge out of contact with the adjacent horizontal support rolls to permit transfer of the convolutions between the inner and outer sections with minimum sliding contact of the convolutions on the horizontal support rolls. A differential drive between the entry and exit pinch rolls ensures that the in-feed and out-feed of the strip material to and from the accumulator are speed matched during such mill match operation.

During the welding mode, when it is desired to replenish the supply of strip material, movement of the incoming strip is stopped, and the convolution transfer annulus is driven by the differential drive in synchronism with the exit pinch rolls in a direction causing positive transfer of the convolutions from the outer section to the inner section to provide a continuous uninterrupted supply of strip material to the exit pinch rolls. After the supply of strip material has been replenished, the entry pinch rolls are accelerated to fill speed, during which the differential drive first causes the speed of the convolution transfer annulus to decelerate down to zero and then accelerate in the opposite direction for effecting positive transfer of the stored convolutions from the inner section to the outer section to expand and fill the accumulator.

The inner support rolls and entry and exit pinch rolls are desirably mechanically interconnected for mechanical synchronous operation thereof. During replenishing of the supply of strip material, both the entry pinch rolls and inner support rolls are stationary thus eliminating the need for any lifting stations around the inner circumference of the accumulator and associated controls and sequencing to incrementally lift the contracted convolutions up off the inner support rolls.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 1:
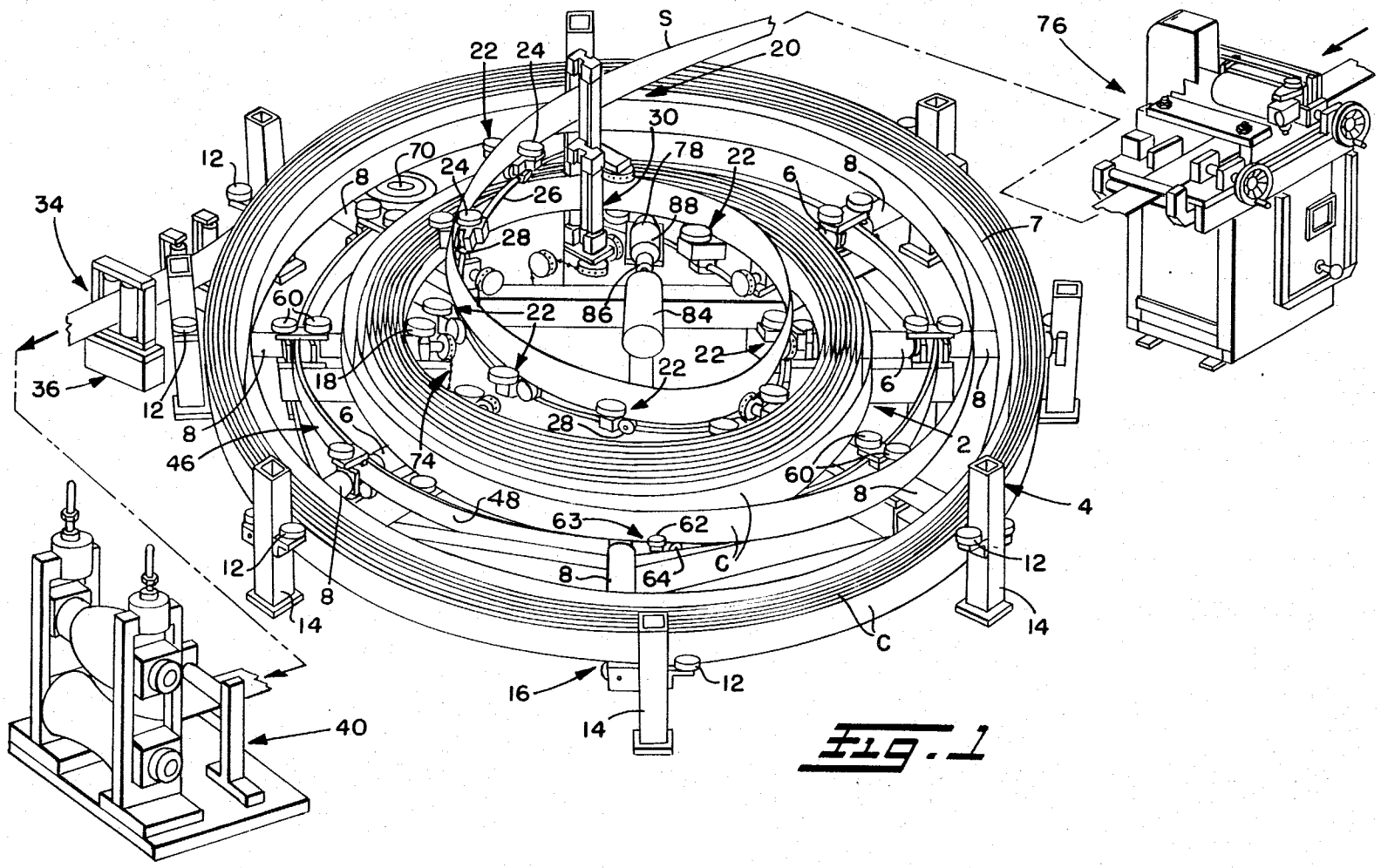
FIG. 1 is a schematic perspective illustration of a preferred form of continuous strip accumulator in accordance with the present invention.

Referring now in detail to the drawings and initially to FIG. 1, a preferred form of continuous strip accumulator in accordance with the present invention is generally indicated by the reference numeral 1. The purpose of such accumulator is to provide for the storage of a continuous length of strip material, such as sheet metal strip, taken from a source of supply, such as a coil, and feed such strip material to a mill, machine or other apparatus. The stored strip material is available for use in providing a continuous supply of the strip material to the mill or other apparatus any time there is an interruption in the source of supply, as when it is necessary to replenish the source of supply, so that the mill can be kept running without interruption.

As shown, the accumulator 1 includes two radially spaced sections or areas 2 and 4 for the storage of the desired number of turns or convolutions C of strip material S on edge with the axes of the convolutions being substantially vertical. The diameters and thus the lengths of the convolutions within the outer section 4 are greater than that of the convolutions within the inner section 2. Accordingly, the transfer of the stored convolutions from the outer section to the inner section will provide additional length of strip material permitting the continued withdrawal of the strip material from the accumulator while the in-feed to the accumulator is interrupted during attachment of the leading end of a new coil to the trailing end of a used up coil as more fully described hereafter.

The convolutions within the inner section 2 are desirably supported by a plurality of radially extending circumferentially spaced horizontal drive support rolls 6 which may be synchronously driven to facilitate movement of the strip material through the accumulator. The strip material enters the accumulator at the innermost turn of the inner section and moves successively through the convolutions to the outer section for withdrawal at the outermost turn thereof during normal mill match operation when the rate of in-feed of the strip material to the accumulator is equal to the rate of outfeed to the mill. The strip material within the outer section 4 may be supported by a plurality of radially extending circumferentially spaced horizontal idle support rolls 8.

The maximum diameter of the outermost turn or convolution in the outer section 4 may be determined by an outer containment ring or circular array of rollers 12 whose axes are generally vertical. The rollers 12 may be supported by a plurality of circumferentially spaced vertically extending posts 14 around the periphery of the accumulator main frame 16, with the rollers being vertically positioned on the posts at such a height that they will be contacted by the outer face of the outermost turn when fully expanded.

Likewise, the minimum permissible diameter of the innermost turn within the inner section 2 of the accumulator may be determined by a plurality of circumferentially spaced vertically extending inner containment rollers 18 suitably supported by the accumulator main frame 16 adjacent the radial inner periphery of the inner section.

Figure 2:
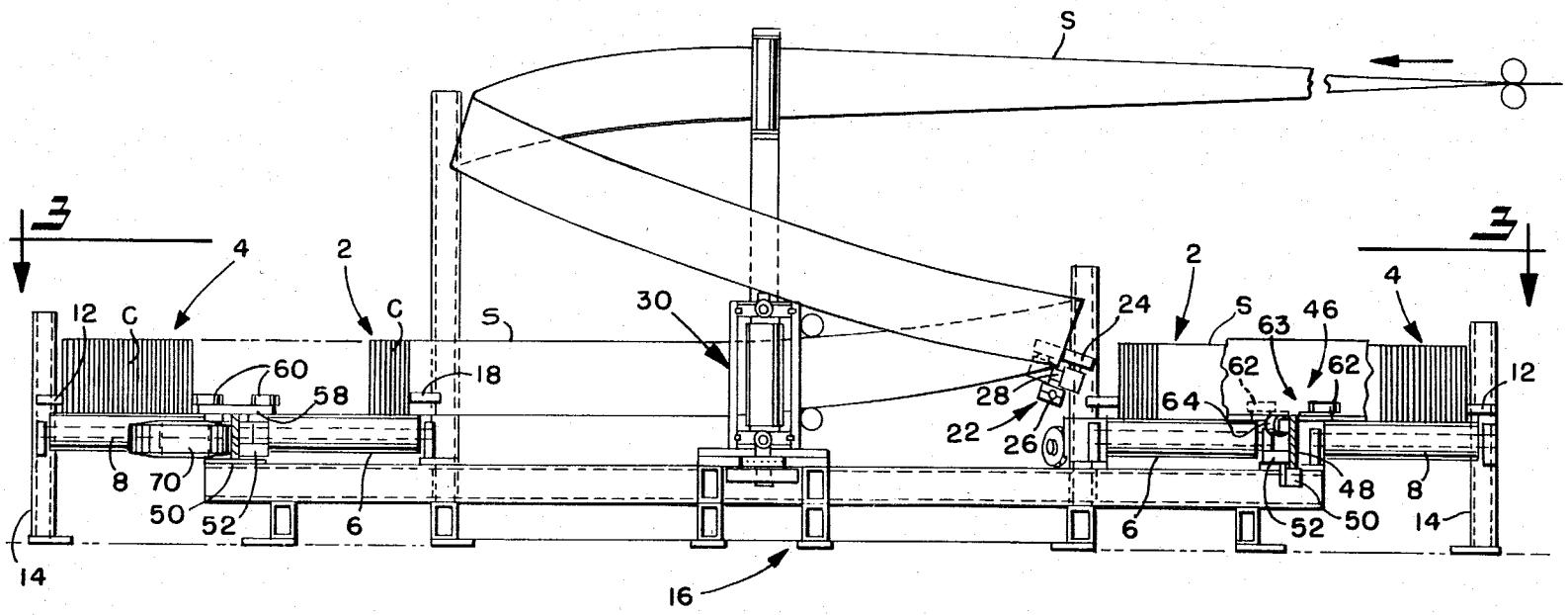
FIG. 2 is a schematic side elevation view of such accumulator.
Figure 3:
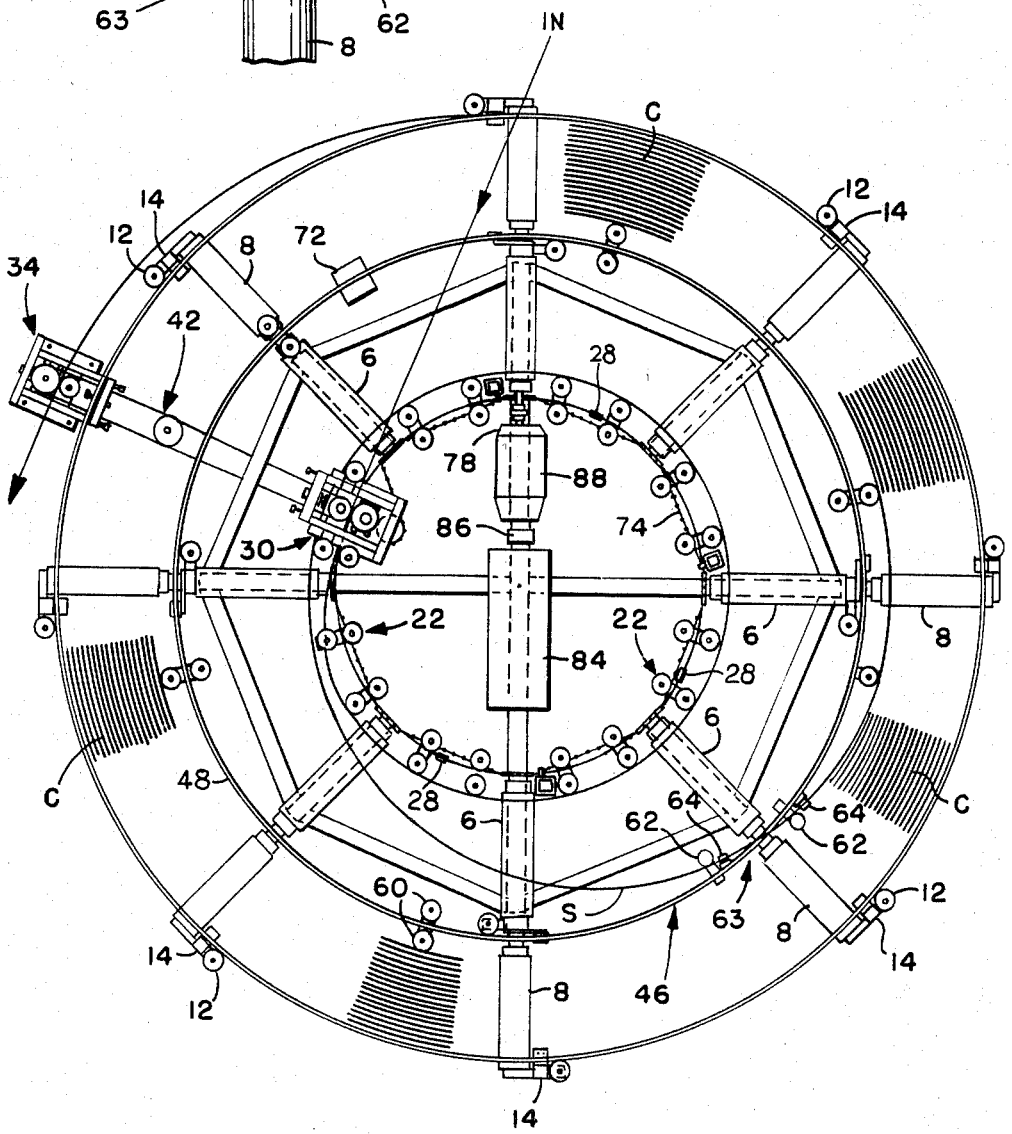
FIG. 3 is a schematic top plan view of such accumulator, substantially as seen from the plane of the line 3—3 of FIG. 2.

The incoming strip material is fed from a source of supply such as an uncoiler to the inner periphery of the inner section of the accumulator in a generally helical descending path defined by a helical feed-in mechanism 20 located generally centrally above the accumulator. As best seen in FIGS. 1 through 3, such helical feed-in mechanism comprises a plurality of strip guides 22 which together define a helical path for the incoming strip material. Each such strip guide includes a pair of radially inner and outer idle guide rollers 24 which are parallel and closely spaced to contain and guide the strip material S in a narrow path therebetween. The strip guides are desirably supported on a support member 26 bent into the desired spiral shape and suitably supported by the accumulator main frame wherever necessary.

Each strip guide 22 may be positioned axially along the support member and rotated to the desired angle for the idle guide rollers 24 to accommodate or match the desired angle and descent of the strip material as it travels along the helical path, after which the strip guides may be firmly secured in place on the support member as by welding, friction clamping or other suitable means. Initially the strip guides may be frictionally retained in their adjusted positions on the support as by providing a split or slot along the length of the support which allows the support to spring open into frictional engagement with the walls of the openings in the strip guides through which the support extends.

A plurality of the strip guides may also have associated therewith radially extending lower strip edge support rollers 28 for supporting the weight of the strip material along the helical path. The number and location of such lower strip edge support rollers may vary as may the number and location of strip guides depending on the number needed to define the desired helical path of the strip material and reduce stress on the strip material resulting from the weight thereof.

Preferably, at the lower end of the helical feed-in mechanism there is provided a pair of entry pinch rolls 30 which are vertically aligned and radially spaced adjacent one another. One or both of the entry pinch rolls are desirably driven at a controlled speed for pulling the strip material through the helical feed-in mechanism and into the inside of the accumulator.

To provide for withdrawal of the strip material from the outermost turn of the accumulator outer section 4, there is a pair of exit pinch rolls 34. Preferably, the mill to which the strip material from the accumulator is fed provides the power for driving the exit pinch rolls by pulling the strip material between the exit pinch rolls. In that event, a drag brake 36 or the like must be connected to the exit pinch rolls to provide the desired drag on the strip material as it is pulled from the accumulator. Alternatively, a separate drive could be provided for driving the exit pinch rolls 34 during mill match operation if it was desired to have a supply of tension-free strip material for the mill.

Suitable guide rolls will of course be required for supporting the strip material during its movement both from the supply to the accumulator and from the accumulator to the mill. Also, suitable turning mechanisms may be required for turning the strip material from the horizontal to the vertical before entering the accumulator and from the vertical to the horizontal after leaving the accumulator and before entering the mill. One such turning mechanism is shown at 40 in FIG. 1.

Figure 4:
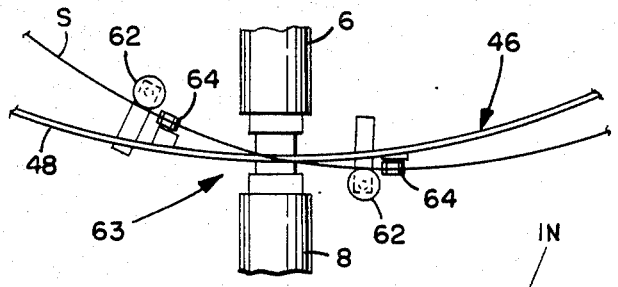
FIG. 4 is an enlarged fragmentary schematic top plan view of the convolution transfer point on the convolution transfer annulus of such accumulator showing the manner in which the bottom edge of the transition spiral is raised by lower strip edge support rollers during transfer of the convolutions between the inner and outer accumulator sections.

The exit drag pinch rolls 34 preferably drive the entry pinch rolls 30 through a differential drive 42 shown schematically in FIGS. 3 and 4 to ensure that the in-feed and out-feed of the strip material to and from the accumulator are speed-matched during mill match operation as more fully described hereafter.

To facilitate transfer of the convolutions of strip material from the inner section 2 to the outer section 4 of the accumulator and vice versa as well as provide adequate support for the strip material during movement between the inner and outer sections, a convolution transfer annulus 46 is provided between such sections. As best seen in FIGS. 2 and 4, such convolution transfer annulus generally comprises a ring 48 which may be supported for rotation on the accumulator main frame 16 as by a plurality of circumferentially spaced support rolls 50 whose axes extend generally radially for supporting the lower edge of the ring and additional rolls 52 whose axes extend generally vertical for engagement with the inner side of such ring. Attached to the top edge of the ring in circumferentially spaced locations around the periphery thereof are a plurality of cross-members 58 on which are mounted pairs of radially spaced containment rollers 60 which define the outer and inner boundaries, respectively, of the inner and outer accumulator sections 2 and 4. Such containment rollers minimize the friction between the convolution transfer annulus and the convolutions in the inner and outer accumulator sections during relative movement of the strip material as the strip material passes from one section to the other. Also, the strip material itself desirably extends between a set of radially spaced containment rollers 62 attached to opposite sides of the ring 48 in circumferentially spaced relation at the convolution transfer point 63 on the convolution transfer annulus (see FIGS. 2–4) for guiding the strip material during movement between such sections. A set of lower strip edge support rollers 64 are also desirably provided on the convolution transfer annulus at the convolution transfer point to support the transition spiral during movement from the inner section to the outer section and raise the transition spiral up slightly to substantially eliminate any sliding contact between the transition spiral and the adjacent horizontal support rolls 6, 8 thus ensuring chatter free motion of the transition spiral along the axes of such horizontal support rolls. Preferably, the maximum that the transition spiral is elevated by the lower strip edge support rollers 64 is approximately one-half inch where the transition spiral has a length of approximately 84 inches.

The differential drive 42 between the exit drag pinch rolls 34 and entry pinch rolls 30 may also be used selectively to drive the convolution transfer annulus 46 when and as needed during the transfer of the convolutions between the inner and outer accumulator sections in a manner to be subsequently described.

Figure 5:
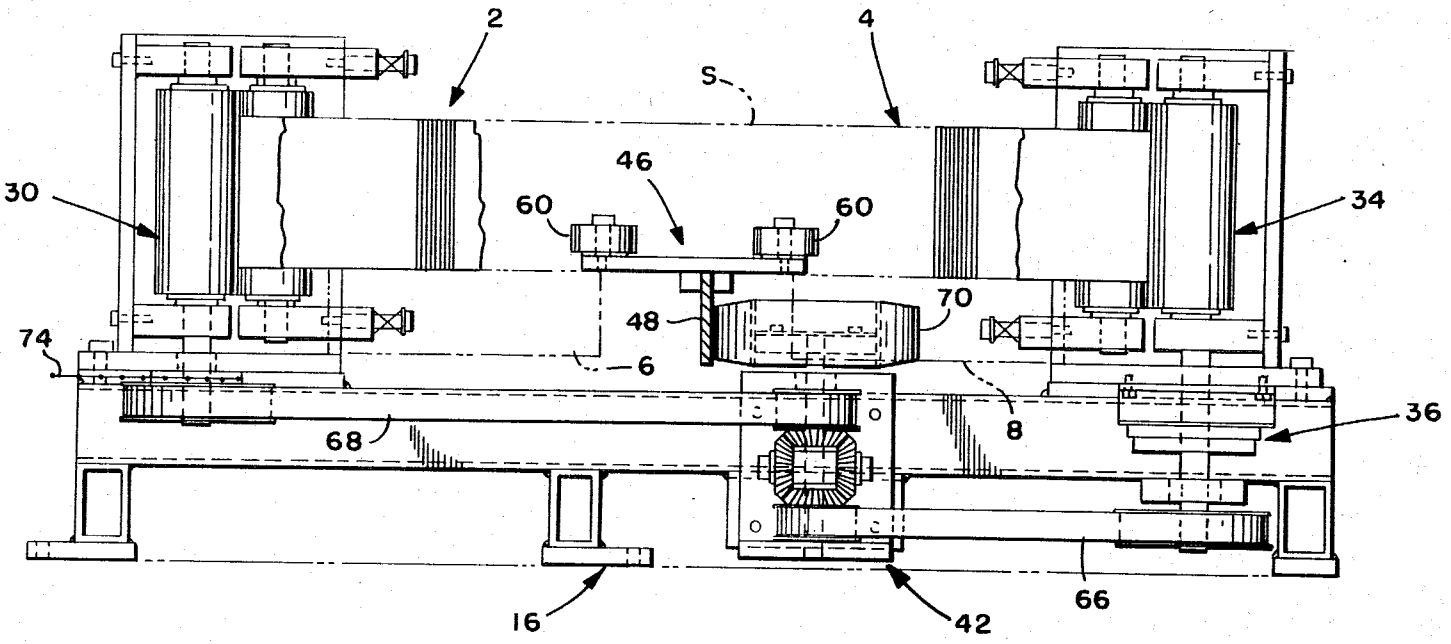
FIG. 5 is an enlarged fragmentary schematic side elevation view showing the differential drive between the accumulator entry and exit pinch rolls and convolution transfer annulus.

As best seen in FIG. 5, the pulling force which is applied to the exiting strip material by the mill line is transferred from the exit drag pinch rolls 34 to the entry pinch rolls 30 through the differential drive 42 whose input is connected to the exit drag pinch rolls by a timing belt 66 and one of the outputs from the differential is connected to the entry pinch rolls by another timing belt 68. Another output from the differential may be drivingly connected to a traction roll 70 in frictional engagement with the outer surface of the annulus ring 48.

When the accumulator is filled to the desired capacity and there is an adequate source of supply of the strip material, the rate of in-feed of the strip material to the accumulator may be mechanically synchronized with the rate of out-feed of strip material from the accumulator by applying a brake schematically shown at 72 in FIG. 3 to the convolution transfer annulus 46 to prevent the convolution transfer annulus from rotating. This converts the differential drive 42 to a reducer, mechanically connecting the entry and exit pinch rolls together for mechanical synchronous operation so that the in-feed and out-feed of the strip material are speed matched as aforesaid. The mill pulls the strip material out of the accumulator with little more tension than required for direct pulling of the strip material from an uncoiler. For example, it is estimated that during a mill run at 100 feet per minute on strip material approximately six inches wide and 0.095 inch thick, approximately 0.3 h.p. is all that would be required from the mill to pull the strip material from the accumulator.

During such mill match operation, the inner drive support rolls 6 are also desirably mechanically synchronously driven by the entry pinch rolls as by interconnecting the input shafts of all of the inner drive support rolls with the shaft of one of the entry pinch rolls using a flexible drive cable, chain or belt such as schematically shown at 74 in FIGS. 1, 3 and 5, or other such suitable drive mechanism such as a bevel gear arrangement may be used for that purpose, whereby all of such rolls will operate in synchronism with each other.

Also during such mill match operation, the convolution transfer annulus is desirably retained against movement by brake 72 with the convolution transfer point 63 angularly displaced from the entry pinch rolls so as to provide proper support for the strip material at that point in its normal spiral flow path from the entry pinch rolls to the tangent point of the innermost turn of the outer stored convolutions. Preferably such tangent point is located approximately 180° from the entry pinch rolls substantially as shown in FIGS. 1 and 3. However, the actual location of such convolution transfer point 63 can vary over a fairly wide range, for example, a 20° spread, without adversely affecting the movement of the strip material from the inner section to the outer section.

When the supply of strip material is almost used up, an end detector or the like (not shown) signals the approaching trailing end of the incoming strip, at which time the braking mechanism 72 for the convolution transfer annulus 46 is released and the incoming strip material is stopped by stopping the entry pinch rolls 30 and/or engaging a strip clamp to clamp the incoming strip material so that the leading end of a new coil can be attached to the trailing end of the incoming strip material as by means of a welder 76 schematically shown in FIG. 1. In the embodiment disclosed herein, a brake 78 is shown in FIG. 1 connected to one of the inner drive rolls 6, whereby when the brake is actuated it simultaneously decelerates all of the inner drive rolls and entry pinch rolls because of the mechanical interconnection 74 therebetween.

As the entry pinch rolls decelerate, the differential drive 42 will accelerate the convolution transfer annulus 46 in a counterclockwise direction as viewed in FIGS. 1 and 3 at the same rate of deceleration as the entry pinch rolls, which causes the convolutions to be transferred from the outer section to the inner section, one at a time, to provide for the uninterrupted withdrawal of the stored length of strip material from the accumulator during welding of a new coil to the strip material. The differential drive thus mechanically regulates the rate of rotation of the convolution transfer annulus and thus the rate of transfer of the convolutions from the outer section to the inner section to match the rate of out-feed of the strip material from the accumulator to the mill line speed.

During such transfer of the convolutions from the outer section to the inner section, there is no need to drive the inner drive support rolls 6, since there is very little motion of the convolutions as they are moved inwardly along and mostly above the inner drive support rolls 6 due to the lower strip edge support rollers 64 on the convolution transfer annulus which raise the transition spiral up during transfer of the convolutions between the inner and outer sections in the manner previously described. Moreover, because such inner drive support rolls are not driven during the weld mode, there is no need to provide any lift stations and associated controls for lifting the inner convolutions off the inner drive rolls when stored thereon.

As will be apparent, the welding operation must be completed and the in-feed to the accumulator resumed before or by the time all of the convolutions have been transferred from the outer section to the inner section or otherwise all of the stored strip material will be used up, thus either causing the strip material to break or possible damage to the mill. However, by proper selection of the storage capacity of the strip accumulator in relation to the speed of the mill and the length of time required to weld on a new coil, this condition will normally not occur. As a safety precaution, a plurality of switches may be provided around the circumference of the outermost turn in the outer section, whereby in the unlikely event that the outermost turn should start to pull away from any one of the switches signalling that the outermost turn is being contracted, the mill line will automatically shut down.

After a new coil has been welded on or otherwise attached to the trailing end of the incoming strip, the incoming strip is releasd and an A.C. motor 84 which may be connected to one of the inner drive support rolls 6 as by means of a suitable reducer and clutch mechanism 86 is started to accelerate the inner drive rolls 6 and entry pinch rolls 30 simultaneously through the cable drive 74. An in-line motor flywheel 88 is also desirably provided between the motor 84 and the inner drive roll 6 to which the motor is connected to control the rate of acceleration of the entry pinch rolls and drive rolls to ensure that the convolutions on the inner drive rolls during resumption of the in-feed after the welding operation will not slide on the inner drive rolls during acceleration to fill speed.

During filling of the accumulator, the differential drive 42 between the exit pinch rolls and entry pinch rolls will automatically mechanically subtract the mill speed from the speed of the entry pinch rolls and drive the convolution transfer annulus accordingly. That is, as the speed of the entry pinch rolls increases, the speed of the convolution transfer annulus correspondingly decreases and reaches zero when the speed of the entry pinch rolls reaches mill speed. Thereafter, as the entry pinch rolls continue to accelerate to the fill speed, which is greater than the mill speed, the differential drive causes the convolution transfer annulus to rotate in the opposite or clockwise direction as viewed in FIGS. 1 and 3, taking the inner stored convolutions from the inner section where their diameters are at a minimum and depositing such convolutions in the outer section to increase their diameters to the maximum.

The fill speed of the entry pinch rolls is desirably constant and may be maintained until the accumulator is substantially filled to capacity or until the innermost convolution of the inner section starts to pull away from the inner support rolls 18. At that time a traveling switch on the inner section may be actuated to energize another switch associated with the convolution transfer annulus when the convolution transfer annulus reaches a given position to apply the necessary braking force to the convolution transfer annulus. Alternatively, a counter may be used to count the number of revolutions of the convolution transfer annulus during transfer of the convolutions from the outer section to the inner section of the accumulator during the welding mode and return during the fill mode.

Before the convolution transfer annulus brake 72 is applied, the power to the A.C. motor drive 84 for the entry pinch rolls 30 is disconnected and, if used, the clutch mechanism 86 is disengaged, whereupon the flywheel 88 causes the entry pinch rolls to coast down for controlled deceleration of the entry pinch rolls. As the coast down speed of the entry pinch rolls approaches the mill speed, the convolution transfer annulus also slows down because of the aforementioned differential drive therebetween. When the speed of the entry pinch rolls equals mill speed, the convolution transfer annulus will stop. Just before that occurs, the brake 72 therefor is engaged to stop the convolution transfer annulus in the final desired position for mill match with the convolution transfer point 63 in the normal desired spiral path of the strip material when the tangent point of the spiral of the innermost turn of the outer stored convolutions is angularly spaced approximately 180° from the entry pinch rolls as aforesaid. Of course, it should be understood that the distance that the convolution transfer annulus travels during coast down will vary with the type of strip material in relation to the energy stored in the flywheel. However, the final position of the convolution transfer annulus need not be that precise, and may vary by as much as 20° or more without adversely affecting the movement of the strip material through the accumulator.

The purpose of the flywheel is to soften the stop so that the convolution transfer annulus stops gradually rather than abruptly. Similarly, the brake for the convolution transfer annulus initially only puts a light drag on the convolution transfer annulus so as not to cause it to stop too abruptly.

When the convolution transfer annulus comes to a stop, once again the differential drive 42 changes to a reducer, mechanically connecting the entry pinch rolls and exit pinch rolls so that the in-feed and out-feed of the strip material to and from the accumulator is again mechanically synchronously matched during mill match operation.

From the foregoing, it will now be apparent that the convolution transfer annulus of the present invention provides a very effective and positive means for transferring the convolutions between the inner and outer sections to expand and contract the convolutions and also provides adequate support for raising and guiding the strip material during its passage between the inner and outer sections. The convolution transfer annulus completely eliminates the need for the strip edge support rolls 6, 8 to be inclined or skewed to assist in such transfer. Accordingly, both the inner drive support rolls 6 and outer idle support rolls 8 may be horizontally disposed, resulting in substantially reduced wear on the rolls due to the fact that there is increased surface contact between the bottom edge of the strip material and the roll surfaces as compared to inclined rolls, thus resulting in less contact pressure at the strip edge where it engages the support rolls, which not only reduces roll wear but also diminishes the chance of deformation of the strip edge. Also, all of the support rolls 6, 8 are preferably radial, thus minimizing sliding of the strip material on the rolls during filling of the accumulator resulting in a further reduction in wear associated with such sliding. As a consequence of such reduced wear, tubular rolls may be used instead of the usual hardened solid ground rolls at a substantial savings in expense and weight.

Dividing the accumulator into two sections also permits the use of relatively short drive support rolls in the inner section and relatively short idle support rolls in the outer section which are less expensive to manufacture and/or replace than the previously used longer support rolls.

Moreover, the aforementioned direct synchronous mechanical drive between the inner drive support rolls and entry pinch rolls eliminates the need for separate D.C. drives and associated electrical controls for synchronous operation of all the drive support rolls, resulting in a substantial cost savings and substantially reducing the complexity and maintenance requirements of the accumulator. Likewise, the need for lift stations and associated controls for lifting the contracted convolutions off the inner drive support rolls during the welding mode is eliminated thus providing additional cost savings and reduced maintenance.

A further advantage of the accumulator of the present invention is that it can be directly tied to the mill without requiring any feed-back signal. Also, the accumulator is internally mechanically synchronized and does not require any electronic synchronization or dancer rolls to indicate the position of the spiral coil within the accumulator.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

What is claimed is:

1. A continuous strip accumulator comprising support means for supporting a single spiral coil consisting of a plurality of convolutions of strip material with the axes of the convolutions substantially vertical, in-feed means for feeding strip material to the innermost turn of the spiral coil, withdrawal means for withdrawing strip material from the outermost turn of the spiral coil, said support means including radial inner and outer sections for storage of the inner and outer convolutions, respectively, of such single spiral coil which inner convolutions are closer to its center of rotation than the outer convolutions, and guide means for supporting and guiding the strip material during movement of the strip material between said inner and outer sections, said guide means including means for positively transferring such convolutions between said inner and outer sections for controlled expansion and contraction of such convolutions, said means for positively transferring comprising a convolution transfer annulus between said inner and outer sections, said convolution transfer annulus being mounted for rotation and including means engageable with such strip material for transferring such convolutions from said outer section to said inner section during rotation of said annulus in one direction and for transferring such convolutions from said inner section to said outer section during rotation of said convolution transfer annulus in the opposite direction, said convolution transfer annulus comprising a ring, said ring having a plurality of circumferentially spaced pairs of radially spaced containment rollers on opposite sides of said ring for defining the outer and inner boundaries, respectively, of said inner and outer sections.

2. The accumulator of claim 1 wherein said ring has a convolution transfer point for transfer of such convolutions between said inner and outer sections, and a set of said containment rollers at said convolution transfer point between which such strip material extends to guide the strip material during movement between said inner and outer sections and assist in the transfer of such convolutions between said inner and outer sections.

3. The accumulator of claim 2 further comprising lower strip edge support roller means on said ring at said convolution transfer point for supporting the lower edge of such strip material during movement between said inner and outer sections.

4. The accumulator of claim 3 wherein such strip material includes a transition spiral extending between such convolutions on said inner and outer sections which is supported by said convolution transfer annulus at said convolution transfer point.

5. The accumulator of claim 4 further comprising horizontal support rolls for supporting the strip material on edge within said inner and outer sections, said lower strip edge support roller means extending above said horizontal support rolls for supporting such transition spiral out of contact with the adjacent support rolls to substantially eliminate sliding contact between such transition spiral and said adjacent horizontal support rolls during transfer of the convolutions between said inner and outer sections.

6. The accumulator of claim 1 wherein said in-feed means comprises a helical in-feed mechanism for feeding strip material in helical fashion to the innermost turn in said inner section, said in-feed mechanism comprising a plurality of strip guides which together define a helical descending path for the strip material to the accumulator, said strip guides being supported on a support bent to the desired spiral shape, said strip guides bing positioned axially along said support and rotated to the desired angle to accommodate and match the desired angle of twist of the strip material descending along such helical path.

7. The accumulator of claim 6 wherein said strip guides are in frictional sliding engagement with said support.

8. The accumulator of claim 7 wherein said strip guides are welded to said support after said strip guides have been properly positioned along said support.

9. The accumulator of claim 1 further comprising a plurality of circumferentially spaced horizontal drive support rolls for supporting the strip material on edge within said inner section.

10. The accumulator of claim 9 further comprising means providing for synchronous operation of said in-feed means and said horizontal drive support rolls that is performed by mechanical means.

11. The accumulator of claim 10 wherein said in-feed means includes entry pinch rolls, and said means providing for mechanical synchronous operation of said in-feed means and said horizontal drive support rolls comprises a mechanical drive interconnecting said entry pinch rolls and all of said horizontal drive support rolls.

12. The accumulator of claim 9 wherein said horizontal drive support rolls are tubular.

13. The accumulator of claim 12 wherein said horizontal drive support rolls extend radially relative to the axial center of said accumulator.

14. The accumulator of claim 9 further comprising a plurality of circumferentially spaced horizontal idle support rolls for supporting the strip material on edge within said outer section.

15. The accumulator of claim 14 wherein said horizontal idle support rolls are tubular.

16. The accumulator of claim 14 wherein said idle support rolls extend radially relative to the axial center of said accumulator.

17. The accumulator of claim 1 further comprising drive means for driving said convolution transfer annulus in such one direction for transferring such convolutions from said outer section to said inner section to provide an uninterrupted supply of strip material for withdrawal from said accumulator at a predetermined rate by said withdrawal means during interruptions in the in-feed of strip material to said accumulator.

18. The accumulator of claim 17 further comprising means for providing synchronous operation of said convolution transfer annulus and said withdrawal means to transfer such convolutions from said outer section to said inner section at a rate to meet the demand for strip material by said withdrawal means during interruptions in the in-feed of strip material to said accumulator.

19. The accumulator of claim 1 further comprising horizontal support rolls for supporting the strip material on edge within said inner and outer sections, such strip material including a transition spiral extending between such convolutions on said inner and outer sections, said convolution transfer annulus including lower strip edge support roller means for supporting the lower edge of such transition spiral during movement between said inner and outer sections.

20. The accumulator of claim 19 wherein said lower strip edge support roller means extends above said horizontal suppot rolls for raising such transition spiral up out of contact with the adjacent support rolls to substantially eliminate sliding contact between such transition spiral and said horizontal support rolls during transfer of such convolutions between said inner and outer sections.

21. The accumulator of claim 1 wherein said in-feed means includes entry pinch rolls, and said withdrawal means includes exit pinch rolls, said accumulator further comprising means providing for mechanical synchronous operation of said entry and exit pinch rolls to ensure that the in-feed and out-feed of the strip material to and from said accumulator are speed matched as long as there is an available supply of strip material to said accumulator.

22. The accumulator of claim 1 further comprising means for stopping the in-feed of strip material to said accumulator during replenishing of the supply of strip material, said guide means comprising a convolution transfer annulus mounted for rotation between said inner and outer sections, said convolution transfer annulus including means for transferring such convolutions between said inner and outer sections during rotation of said annulus in opposite directions, and means for rotating said convolution transfer annulus in a direction for transferring such convolutions from said outer section to said inner section to contract such convolutions thereby providing an uninterrupted supply of strip material to said withdrawal means whenever the in-feed of strip material to said accumulator is stopped.

23. The accumulator of claim 22 wherein said in-feed means includes entry pinch rolls, and said withdrawal means includes exit pinch rolls, said accumulator further comprising means for providing mechanical synchronous operation of said entry and exit pinch rolls to ensure that the in-feed and out-feed of the strip material to and from said accumulator are speed matched as long as there is an available supply of strip material to said accumulator.

24. The accumulator of claim 23 further comprising means for providing synchronous operation of said convolution transfer annulus and said exit pinch rolls to transfer such convolutions from said outer section to said inner section to provide an uninterrupted supply of strip material to said exit pinch rolls during interruptions in the in-feed of strip material to said accumulator.

25. A continuous strip accumulator comprising support means for supporting a single spiral coil consisting of a plurality of convolutions of strip material with the axes of the convolutions substantially vertical, in-feed means for feeding strip material to the innermost turn of the spiral coil, withdrawal means for withdrawing strip material from the outermost turn of the spiral coil, said support means including radial inner and outer sections for storage of the inner and outer convolutions, respectively, of such single spiral coil which inner convolutions are closer to its center of rotation than the outer convolutions, and guide means for supporting and guiding the strip material during movement of the strip material between said inner and outer sections, said guide means comprising a convolution transfer annulus between said inner and outer sections, said in-feed means including entry pinch rolls, and said withdrawal means including exit pinch rolls, said accumulator further comprising means providing for synchronous operation of said entry and exit pinch rolls that is performed by mechanical means to ensure that the in-feed and out-feed of the strip material to and from said accumulator are speed matched as long as there is an available supply of strip material to said accumulator, said means for providing synchronous operation comprising a differential drive between said convolution transfer annulus and said exit and entry pinch rolls.

26. The accumulator of claim 25 wherein said withdrawal means includes means for pulling the strip material between said exit pinch rolls which provides the power to drive said convolution transfer annulus through said differential drive.

27. A continuous strip accumulator comprising support means for supporting a single spiral coil consisting of a plurality of convolutions of strip material with the axes of the convolutions substantially vertical, in-feed means for feeding strip material to the innermost turn of the spiral coil, withdrawal means for withdrawing strip material from the outermost turn of the spiral coil, said support means including radial inner and outer sections for storage of the inner and outer convolutions, respectively, of such single spiral coil which inner convolutions are closer to its center of rotation than the outer convolutions, and guide means for supporting and guiding the strip material during movement of the strip material between said inner and outer sections, means for stopping the in-feed of strip material to said accumulator during replenishing of the supply of strip material, said guide means comprising a convolution transfer annulus mounted for rotation between said inner and outer sections, said convolution transfer annulus including means for transferring such convolutions between said inner and outer sections during rotation of said annulus in opposite directions, and means for rotating said convolution transfer annulus in a direction for transferring such convolutions from said outer section to said inner section to contract such convolutions thereby providing an uninterrupted supply of strip material to said withdrawal means whenever the in-feed of strip material to said accumulator is stopped, said in-feed means including entry pinch rolls, and said withdrawal means including exit pinch rolls, said accumulator further comprising means for providing synchronous operation of said entry and exit pinch rolls that is performed by mechanical means to ensure that the in-feed and out-feed of the strip material to and from said accumulator are speed matched as long as there is an available supply of strip material to said accumulator, and means for providing synchronous operation of said convolution transfer annulus and said exit pinch rolls to transfer such convolutions from said outer section to said inner section to provide an uninterrupted supply of strip material to said exit pinch rolls during interruptions in the in-feed of strip material to said accumulator, said means for providing synchronous operation of said entry and exit pinch rolls when said entry and exit pinch rolls are speed matched and for providing synchronous operation of said convolution transfer annulus and said exit pinch rolls when the in-feed of strip material to said accumulator is interrupted comprises a differential drive between said exit pinch rolls and each of said entry pinch rolls and said convolution transfer annulus.

28. The accumulator of claim 27 further comprising means for retaining said convolution transfer annulus against movement while the in-feed and out-feed to and from said accumulator are speed matched, and means for stopping said entry pinch rolls while the source of supply of strip material to said accumulator is being replenished, said differential drive causing said convolution transfer annulus to operate in synchronism with said exit pinch rolls while said entry pinch rolls are stopped or retained against movement.

29. The accumulator of claim 28 wherein said withdrawal means includes means for pulling the strip material between said exit pinch rolls which produces the power to drive one or the other of said entry pinch rolls and convolution transfer annulus through said differential drive.

30. The accumulator of claim 28 further comprising means for driving said entry pinch rolls at a speed greater than said exit pinch rolls during filling of said accumulator with strip material, said differential drive being operative mechanically to subtract the speed of said exit pinch rolls from the speed of said entry pinch rolls and drive said convolution transfer annulus in the opposite direction at such differential rate of speed for transferring convolutions from said inner section where their diameters are at a minimum to said outer section where their diameters are at a maximum.

31. The accumulator of claim 30 wherein said means for driving said entry pinch rolls at a speed greater than said exit pinch rolls comprises an A.C. motor.

32. The accumulator of claim 31 further comprising a flywheel connected to said entry pinch rolls for providing controlled acceleration and deceleration of said entry pinch rolls.

33. The accumulator of claim 32 further comprising brake means for braking said entry pinch rolls and said A.C. motor.

34. The accumulator of claim 33 further comprising a plurality of circumferentially spaced horizontal drive support rolls for supporting the strip material on edge within said inner section, and means providing for mechanical synchronous operation of said drive support rolls and entry pinch rolls.

35. The accumulator of claim 34 wherein one of said drive rolls is selectively driven by said A.C. motor which drives all of said drive support rolls and said entry pinch rolls through said mechanical drive.

36. The accumulator of claim 34 wherein said means providing for synchronous operation of said drive rolls and entry pinch rolls comprises a mechanical drive interconnecting all of said entry pinch rolls and drive rolls.

37. A continuous strip accumulator comprising support means for supporting a single spiral coil consisting of a plurality of convolutions of strip material with the axes of the convolutions substantially vertical, in-feed means for feeding strip material to the innermost turn of the spiral coil, withdrawal means for withdrawing strip material from the outermost turn of the spiral coil, said support means including radial inner and outer sections for storage of the inner and outer convolutions, respectively, of such single spiral coil which inner convolutions are closer to its center of rotation than the outer convolutions, and guide means for supporting and guiding the strip material during movement of the strip material between said inner and outer sections, and means for stopping the in-feed of strip material to said accumulator during replenishing of the supply of strip material, said guide means comprising a convolution transfer annulus mounted for rotation between said inner and outer sections, said convolution transfer annulus including means for transferring such convolutions between said inner and outer sections during rotation of said annulus in opposite directions, and means for rotating said convolution transfer annulus in a direction for transferring such convolutions from said outer section to said inner section to contract such convolutions thereby providing an uninterrupted supply of strip material to said withdrawal means whenever the in-feed of strip material to said accumulator is stopped.

38. The accumulator of claim 37 wherein said in-feed means includes entry pinch rolls, and said withdrawal means includes exit inch rolls, said accumulator further comprising means for providing synchronous operation of said entry and exit pinch rolls that is performed by mechanical means to ensure that the in-feed and outfeed of the strip material to and from said accumulator are speed matched as long as there is an available supply of strip material to said accumulator.

39. The accumulator of claim 38 further comprising means for providing synchronous operation of said convolution transfer annulus and said exit pinch rolls to transfer such convolutions from said outer section to said inner section to provide an uninterrupted supply of strip material to said exit pinch rolls during interruptions in the in-feed of strip material to said accumulator.

40. The accumulator of claim 37 further comprising a plurality of circumferentially spaced horizontal tubular drive support rolls for supporting the strip material on edge within said inner section.

41. The accumulator of claim 40 wherein said horizontal drive support rolls extend radially relative to the axial center of said accumulator.

42. The accumulator of claim 37 further comprising a plurality of circumferentially spaced horizontal drive support rolls for supporting the strip material on edge within said inner section, and a plurality of circumferentially spaced horizontal idle support rolls for supporting the strip material on edge within said outer section.

43. The accumulator of claim 42 wherein said horizontal idle support rolls are tubular.

44. The accumulator of claim 42 wherein said idle support rolls extend radially relative to the axial center of said accumulator.

45. The accumulator of claim 25 wherein said withdrawal means includes means for pulling the strip material between said exit pinch rolls which provides the power to drive said entry pinch rolls through said differential drive.

* * * * *